US008246809B2

(12) United States Patent
Francois et al.

(10) Patent No.: US 8,246,809 B2
(45) Date of Patent: Aug. 21, 2012

(54) APPARATUS AND METHOD FOR ELECTROPLATING A SUBSTRATE IN A CONTINUOUS WAY

(75) Inventors: Roger Francois, Sint-Eloois-Vijve (BE); Luc Hofman, Deinze (BE)

(73) Assignee: NV Bekaert SA, Zwevegem (BE)

( * ) Notice: Subject to any disclaimer, the term of this patent is extended or adjusted under 35 U.S.C. 154(b) by 772 days.

(21) Appl. No.: 12/305,348

(22) PCT Filed: Jun. 19, 2007

(86) PCT No.: PCT/EP2007/056059

§ 371 (c)(1),
(2), (4) Date: Dec. 17, 2008

(87) PCT Pub. No.: WO2007/147818

PCT Pub. Date: Dec. 27, 2007

(65) Prior Publication Data

US 2009/0277796 A1 Nov. 12, 2009

(30) Foreign Application Priority Data

Jun. 20, 2006 (EP) ..... 06115692

(51) Int. Cl.
*C25D 5/00* (2006.01)
*C25D 7/06* (2006.01)

(52) U.S. Cl. ..... 205/138; 205/137

(58) Field of Classification Search ..... 205/137, 205/138

See application file for complete search history.

(56) References Cited

U.S. PATENT DOCUMENTS

| | | | | |
|---|---|---|---|---|
| 2,075,331 | A * | 3/1937 | Antisell | 205/138 |
| 3,871,982 | A | 3/1975 | Idstein | |
| 4,367,125 | A * | 1/1983 | Avellone | 205/96 |
| 4,395,320 | A * | 7/1983 | Kasashima et al. | 204/206 |
| 4,492,615 | A | 1/1985 | LeFebvre | |
| 5,015,340 | A | 5/1991 | Colombier et al. | |
| 6,797,391 | B2 | 9/2004 | Shibato et al. | |

FOREIGN PATENT DOCUMENTS

| | | |
|---|---|---|
| GB | 434116 | 1/1935 |

* cited by examiner

*Primary Examiner* — Edna Wong
(74) *Attorney, Agent, or Firm* — Foley & Lardner LLP

(57) ABSTRACT

An apparatus and a method deposits a metal coating on an electrically conductive substrate in a continuous way. The apparatus includes at least one plating vessel for receiving an electrolyte solution and at least one plating unit. The plating unit includes a first zone comprising at least one first electrode (anode) connected to a positive pole of a power supply; a second zone comprising at least one second electrode (cathode) connected to a negative pole of the power supply; and an intermediate zone between the first zone and the second zone. The intermediate zone separates the first zone from the second zone by a predetermined distance larger than zero. The substrate functions as a cathode having a current density Jc when the substrate is facing the first electrode, and as an anode having a current density Ja when the substrate is facing the second electrode.

13 Claims, 1 Drawing Sheet

APPARATUS AND METHOD FOR ELECTROPLATING A SUBSTRATE IN A CONTINUOUS WAY

FIELD OF THE INVENTION

The invention relates to an apparatus and to a method for electroplating a substrate in a continuous way.

BACKGROUND OF THE INVENTION

Electroplating is a commonly known process to deposit a metal or metal alloy coating on a substrate.

In an electroplating process a negative charge is placed on the substrate to be coated and the substrate is immersed in a solution containing a salt of the metal to be deposited.

The electroplating process can be used to deposit a metal or metal alloy coating on an elongated substrate such as a metal foil in a continuous process. However, in a continuous process one is confronted with a number of problems.

A first problem is that damages such as scratches and pinholes can be created on the metal or metal alloy coating or on any underlying layer due to the contact of the substrate with the electrical conductors. This can be problematic especially when the metal or metal alloy layer or any underlying layer is very thin.

A second problem is the high difficulty to obtain a homogeneous coating due to the inhomogeneous electrical field. This is in particular the case when large area substrates such as foils are used. This problem is even stronger for substrates having a low conductivity.

SUMMARY OF THE INVENTION

It is an object of the present invention to provide an apparatus for continuously electroplating a substrate avoiding the problems of the prior art.

It is another object of the invention to provide an apparatus that allows depositing a coating on a substrate without creating damages, scratches, pinholes, . . . on the coating.

It is a further object to provide an apparatus that allows depositing a homogeneous coating even on a large area substrate.

Furthermore, it is an object to provide a method to continuously deposit a metal or metal alloy coating with a high efficiency on a continuously conducting substrate with high electrical resistance.

According to a first aspect of the present invention, an apparatus for depositing a metal coating on an electrically conductive substrate in a continuous way is provided.

The apparatus comprises at least one plating vessel for receiving an electrolyte solution and at least one plating unit and means to pass said substrate through said at least one plating vessel. The at least one plating unit comprises

- a first zone comprising at least one first electrode (anode), the first electrode being connected to a positive pole of a power supply;
- a second zone comprising at least one second electrode (cathode), the second electrode being connected to a negative pole of a power supply;
- an intermediate zone between said first zone and said second zone, the intermediate zone separating the first zone from the second by a predetermined distance being larger than zero.

The substrate passes consecutively said first zone at a predetermined distance from the first electrode, the intermediate zone and the second zone at a predetermined distance from the second electrode.

The substrate is functioning as a cathode having a current density Jc when the substrate is facing the first electrode whereas the substrate is functioning as an anode having a current density Ja when facing the second electrode. The current density Ja is larger than the current density Jc.

This means that metal coating will be deposited on the substrate when the substrate is facing the anode and that metal coating will dissolve when the substrate is facing the cathode. In order to get an increase in metal coating deposited on the substrate the current density Ja has to be larger than the current density Jc.

The current density Jc depends on the type of plating bath used. However, preferably, the ratio Ja/Jc is higher than 10 and is more preferably between 10 and 90 as for example between 25 and 60.

One way to influence the current densities is by having a second electrode with a length much lower than the length of the first electrode. The length of the first electrode is preferably at least 30 cm, and more preferably at least 60 cm as for example 120 cm.

The length of the second electrode is preferably lower than 5 cm as for example lower than 1 cm.

The direction in which the substrate passes through the plating vessel is preferably so that the substrate is first facing the first electrode and is subsequently facing the second electrode.

It is important for the present invention to limit the electron flow through the electrolyte solution and to avoid short circuiting.

A first means to limit the electron flow through the electrolyte solution is by providing an intermediate zone between the first zone and the second zone.

A second means to limit the electron flow through the electrolyte solution and to avoid short circuiting is by providing the electrodes with shields. It is possible to provide either the first electrode or the second electrode with shields or to provide both the first electrode and the second electrode with shields.

The shields comprise for example closed insulating side walls. Preferably, the distance between the substrate and the lowest point of the side walls is small and more preferably the distance between the substrate and the lowest point of the side walls is maximum the same as the distance between the substrate and the first and the second electrode.

The distance between the substrate and the first electrode and between the substrate and the second electrode is preferably small. If the distance is too high the path through the electrolyte solution is promoted instead of the path through the substrate. In any case, contact between the substrate and the first and the second electrode has to be avoided.

Preferably, the distance between the substrate and the first electrode and between the substrate and the second electrode is lower than 3 cm and more preferably the distance is between 3 and 0.2 cm as for example between 1 cm and 0.5 cm.

In a preferred embodiment of the present invention the apparatus comprises a number of plating units, each plating unit comprising a first zone, a second zone and an intermediate zone. Between two consecutive units preferably an activation zone is present. This activation zone is separating two consecutive plating units by a predetermined distance being larger than zero. Preferably, this distance ranges between 1 and 20 cm, for example between 1 and 10 cm.

In principle there is no limitation in the number of plating units. The number of plating units is determined by the thickness of the metal or metal alloy coating that is requested.

The number of plating units is preferably higher than 2 and ranges for example between 2 and 20.

The activation zone allows the removal of oxides of the metal or metal alloy coating deposited on the substrate and ensures to obtain the required adhesion between consecutive metal coatings.

The apparatus according to the present invention can be used to deposit any kind of metal coating. With metal coating is meant any kind of metal or any kind of metal alloy coating such a nickel coating, a zinc coating, a copper coating and their corresponding alloys such as a copper-zinc coating.

The electrolyte solution comprises a salt of the metal to be deposited. Any electrolyte solution known in the art can be used.

The apparatus may comprise one plating vessel or more than one plating vessel.

The first zone, the intermediate zone and the second zone can for example be present in one plating vessel or in separated plating vessels. In case the apparatus comprises more than one plating unit, the different plating units can be present in one plating vessel or in separated plating vessels.

As substrate any kind of elongated substrate that is electrically conductive can be considered. The substrate can be electrically conductive as such or it can be made electrically conductive for example by applying a metal coating on it or by adding activators and/or catalysts.

Preferably, the substrate comprises a metal wire, a metal cord, a metal film or a metallized wire, a metallized cord, a metallized textile, a metallized paper or a metallized film.

In a preferred embodiment, the substrate comprises a metallized polymer substrate.

The polymer substrate comprises preferably at least one thermosetting resin, thermoplastic resin, polyester resin, polyimide resin, condensation polymer, or mixture of two or more thereof.

The polymer substrate can be made with or without fillers, woven glass, non-woven glass and/or other fibrous materials. The polymer substrate can be a single layered film or a multilayered film.

The thermosetting resins that can be used to form the polymer substrate include phenolic resins, phenol-aldehyde resins, furan resins, amino-plast resins, alkyd resins, allyl resins, epoxy resins, epoxy prepregs, polyurethane resins, thermosetting polyester resins, polyimide bis-maleimide resins, polymaleimide-epoxy resins, polymaleimide-isocyanate resins, silicone resins, cyanate resins, cyanate-epoxy resins, cyanate-polymaleimide resins, cyanate-epoxy-polymaleimide resins, and the like.

The thermoplastic resins include poly alpha-olefins, polyethylene, polypropylene, poly 4-methyl-pentene-1, ethylene/vinyl copolymers, ethylene vinyl acetate copolymers, ethylene acrylic acid copolymers, ethylene methacrylate copolymers, ethylmethylacrylate copolymers, etc.; thermoplastic propylene polymers such as polypropylene, ethylene-propylene copolymers, etc.; vinyl chloride polymers and copolymers; vinylidene chloride polymers and copolymers; polyvinyl alcohols; acrylic polymers made from acrylic acid, methacrylic acid, methylacrylate, methacrylate, acrylamide, and the like; fluorocarbon resins such as polytetrafluoroethylene, polyvinylidiene fluoride, and fluorinated ethylene-propylene resins; styrene resins such as a polystyrene, alpha-methylstyrene, high impact polystyrene, acrylonitrilebutadiene-styrene polymers, and the like.

The polyester resins include those made from dibasic aliphatic and aromatic carboxylic acids and diols or triols. These include polyethylene terephthalate, polyethylene naphthalate, polybutylene terephthalate, and the like. The polycarbonates, which are long chained linear polyesters derived from carbonic acids (e.g., phosgene) and dihydric phenols (e.g., bisphenol A), can be used.

The polyimide resins are particularly useful. These can be made by a reaction involving contacting a tetrabasic acid dianhydride with an aromatic diamine giving first a polyamic acid which is then converted by heat or catalyst into a high molecular weight linear polyimide.

The condensation polymers that are useful include the polyamides, polyetherimides, polysulfones, polyethersulfones, polybenzazoles, aromatic polysulfones, polyphenylene oxides, polyether ether ketones, and the like.

The metal coating applied on the polymer substrate is preferably functioning as a tie coat layer for the metal coating to be deposit in the electroplating process according to the present invention.

Preferred metal coatings comprise a chromium or nickel or an alloy thereof such as nickel-copper alloys or nickel-chromium alloys.

The first electrode can be soluble or not.

The apparatus can be designed so that the substrate passes through the plating vessel horizontally or the apparatus can be designed so that the substrate passes through the plating vessel vertically.

The apparatus can be designed to deposit a metal coating on one side of the substrate or to deposit a metal coating on both sides of the substrate.

An important advantage of the present invention that damages such as scratches, pinholes, . . . on the coating or any underlying layer are avoided. In the methods known in the prior art the creation of damages is a serious problem. These damages are mainly the consequence of the contact of the electrical conductors with the substrate. As the apparatus according to the present invention do not require such electrical conductors, the problem of creating damages is avoided.

Another advantage of the present invention is that the apparatus allows depositing homogeneous coatings on a large area substrate, even on a wider substrate than is possible with the apparatuses known in the art. The high homogeneity on large area substrates is achieved due to the very homogeneous electrical field that is created according to the present invention.

According to a second aspect of the present invention a method to continuously deposit a metal or metal alloy coating on an electrically conductive substrate is provided.

The method comprises the steps of providing an apparatus comprising at least one plating vessel for receiving an electrolyte solution; at least one plating unit and means to pass said substrate through said at least one plating vessel; said at least one plating vessel comprising a first zone comprising at least one first electrode (anode) connected to a positive pole of a power supply; a second zone comprising at least one second electrode (cathode) connected to a negative pole of a power supply and at least one intermediate between said first zone and said second zone; said intermediate zone separating said first zone from said second zone by a predetermined distance being larger than zero;

passing said substrate through said at least one plating vessel in a predetermined direction, whereby said substrate passes consecutively said first zone, said intermediate zone and said second zone, whereby said substrate when facing said first electrode is functioning as a cathode having a current density Jc and said substrate when facing said second electrode is functioning as an anode having a current density Ja, said current density Ja being larger than said current density Jc.

BRIEF DESCRIPTION OF THE DRAWINGS

The invention will now be described into more detail with reference to the accompanying drawings wherein.

DESCRIPTION OF THE PREFERRED EMBODIMENTS OF THE INVENTION

Figure 1:
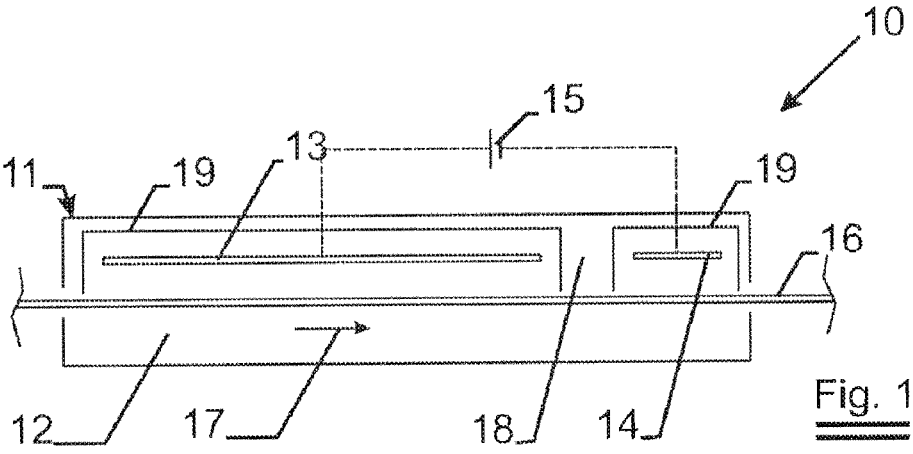
FIG. 1 shows a first set-up of an apparatus according to the present invention to deposit a metal coating on one side of a substrate.

A schematic representation of an apparatus according to the present invention is given in FIG. 1.

The apparatus 10 comprises a plating vessel 11 for receiving an electrolyte solution 12.

The apparatus comprises a first zone 13, an intermediate zone 18 and a second zone 14. The first zone 13 comprises a first electrode (anode)

connected to the positive pole of a power supply 15 and the second zone 14 comprises a second electrode (cathode) connected to the negative pole of a power supply 15. The intermediate zone 18 is separating the first zone 13 from the second zone 14 by a predetermined distance being larger than 0. Preferably, the distance between the first zone 13 and the second zone 14 ranges between 1 and 20 cm and more preferably between 1 and 10 cm.

An elongated substrate 16 passes through the plating vessel 11 consecutively through said first zone, said intermediate zone and said second zone. The substrate thereby passes the first electrode and the second electrode at a distance of 1 cm. The moving direction of the substrate is given by arrow 17.

The elongated substrate 16 comprises a metallized polymer film, more particularly a metallized polyimide film. The metal applied on the polyimide comprises for example chromium or nickel or an alloy thereof such as a nickel-copper alloy or a nickel-chromium alloy. The metal layer has a low electrical conductivity and a thickness ranging between 1000 and 2500 Angstrom. The metal layer is functioning as a tie coat layer for the copper layer that is deposited during the electroplating process according to the present invention.

The first electrode has a length of 90 cm and the second electrode has a length of 1 cm.

The substrate 16 is functioning as a cathode having a current density Jc when the substrate is facing the first electrode, whereas the substrate is functioning as an anode having a current density Ja when the substrate is facing the second electrode. The ratio Ja/Jc is at least 10 as for example 20. This means that metal coating will be deposited on the substrate when the substrate 16 is facing the first electrode and that metal coating will dissolve when the substrate 16 is facing the second electrode. As the current density Ja is larger than the current density Jc, an increase in metal coating on substrate 16 will be realized.

To limit the electron flow through the electrolyte, an intermediate zone 18 is separating the first zone 13 from the second zone 14 by a distance of for example 2 cm.

Furthermore, the first electrode and the second electrode are provided with shields 19.

The electrolyte solution comprises a copper salt.

During electroplating, the electrons should flow from the first electrode to the substrate 16 and from the substrate 16 to the second electrode. To stimulate the electron flow to follow the desired path the electrical resistance of the path through the substrate 16 is preferably lower than the electrical resistance of the path through the electrolyte solution 12.

Figure 2:
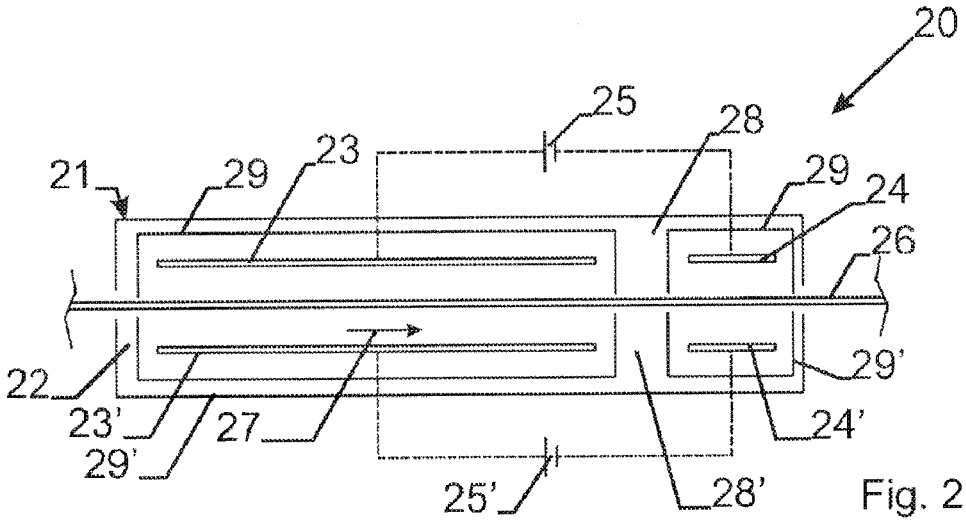
FIG. 2 shows a second set-up of an apparatus according to the present invention to deposit a metal coating on both sides of a substrate.

FIG. 2 shows an apparatus 20 according to the present invention to coat a substrate 26 on both sides.

The apparatus comprises a plating vessel 21 for receiving an electrolyte solution 22.

The apparatus 20 comprises first zones 23, 23', intermediate zones 28, 28' and second zones 24, 24'. The first zones comprise first electrodes connected to the positive pole of a power supply 25 and the second zones comprise second electrodes connected to the negative pole of a power supply 25. The electrodes of zone 23 and of zone 24 are located at one side of the substrate 26. The electrodes of zone 23' and of zone 24' are located at the other side of the substrate 26.

The elongated substrate 26 passes through the plating vessel 21 at a distance of 1 cm from the electrodes of first zones 23 and 23' and of the electrodes of second zones 24 and 24'. The moving direction of the substrate is given by arrow 27.

The electrodes of first zones 23 and 23' have a length of 90 cm and the electrodes of second zones 24 and 24' have a length of 1 cm.

The electrolyte solution comprises a copper salt.

The ratio of Ja/Jc is at least 10 and more preferably at least 20.

The electron flow through the electrolyte is limited by the presence of intermediate zones 28 and 28', respectively between first zone 23 and second zone 24 and between first zone 23' and second zone 24'. Furthermore the electrodes of the first zones 23 and 23' and the electrodes of second zones 24, 24' are provided with shields 29 and 29'.

Figure 3:
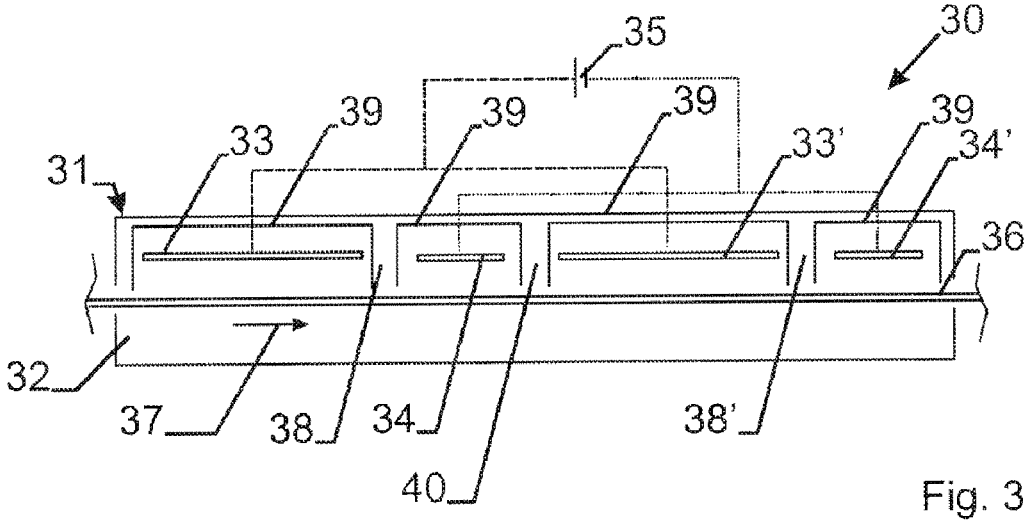
FIG. 3 shows a third set-up of an apparatus according to the present invention comprising two units.

FIG. 3 shows an apparatus 30 comprising a plating vessel 31 for receiving an electrolyte solution 32.

The apparatus comprises two plating units. Each plating unit comprises a first zone 33 and 33', an intermediate zone 38 and 38' and a second zone 34 and 34'.

The first zones 33 and 33' comprise first electrodes connected to the positive pole of a power supply 35; the second zones 34 and 34' comprise second electrodes connected to the negative pole of a power supply 35.

For a person skilled in the art, it is clear that the number of units can be increased. Different units can be connected to the same power supply or two different power supplies.

Between first zone 33 and second zone 34 there is an intermediate zone 38; between first zone 33' and second zone 34' there is an intermediate zone 38'.

The electrodes of the first zones 33 and 33' and the electrodes of the second zone 34 and 34' are preferably provided with shields 39.

Preferably, between two consecutive units an activation zone 40 is present. The activation zone 40 allows that oxides are removed from the deposited coating and allows to obtain a good adhesion between consecutively deposited coatings.

The moving direction of the elongated substrate 36 is given by arrow 37.

The invention claimed is:

1. A method to continuously deposit a metal or metal alloy coating on an electrically conductive substrate, said method comprising the steps of:

providing an apparatus comprising at least one plating vessel for receiving an electrolyte solution and at least one plating unit, said at least one plating unit comprising a first zone comprising at least one first electrode connected to a positive pole of a power supply, a second zone comprising at least one second electrode connected to a negative pole of the power supply and at least one intermediate zone between said first zone and said second zone, said intermediate zone separating said first zone from said second zone by a predetermined distance that is larger than zero; and passing said electrically conductive substrate through said at least one plating vessel in a predetermined direction to deposit said metal or metal alloy coating on said electrically conductive substrate, wherein said substrate passes consecutively said first zone, said intermediate zone and said second zone, and wherein said substrate when facing said first electrode is functioning as a cathode having a current density Jc and said substrate when facing said second electrode is functioning as an anode having a current density Ja, said current density Ja being larger than said current density Jc.

2. A method according to claim 1, wherein a ratio Ja/Jc is at least 10.

3. A method according to claim 1, wherein said first electrode has a length of at least 30 cm and said second electrode has a length of maximum 5 cm.

4. A method according to claim 1, wherein said intermediate zone creates a distance between said first zone and said second zone ranging between 1 and 10 cm.

5. A method according to claim 1, wherein said first electrode, said second electrode, or a combination thereof is shielded.

6. A method according to claim 1, wherein the at least one plating unit comprises at least two consecutive plating units, and wherein the apparatus further comprises an activation zone between the two consecutive plating units such that said activation zone separates the two consecutive plating units by a separating distance that is larger than zero.

7. A method according to claim 6, wherein the separating distance between the two consecutive plating units ranges between 1 and 10 cm.

8. A method according to claim 1, wherein a separating distance between said substrate and said first and second electrodes is lower than 3 cm.

9. A method according to claim 1, wherein said substrate comprises a metal wire, a metal cord, a metal film, a metallized wire, a metallized cord or a metallized film.

10. A method according to claim 1, wherein the substrate passes horizontally through said plating vessel.

11. A method according to claim 1, wherein the substrate passes vertically through said plating vessel.

12. A method according to claim 1, wherein the metal coating is applied on both sides of said substrate.

13. A method according to claim 1, wherein external power is not in electrical contact with the substrate via solid electrical connectors.

* * * * *